US010993565B2

(12) United States Patent
Larney

(10) Patent No.: US 10,993,565 B2
(45) Date of Patent: May 4, 2021

(54) STEMLESS WINE GLASSES RACK

(71) Applicant: Fifi Lynn Larney, Girard, OH (US)

(72) Inventor: Fifi Lynn Larney, Girard, OH (US)

( * ) Notice: Subject to any disclaimer, the term of this patent is extended or adjusted under 35 U.S.C. 154(b) by 0 days.

(21) Appl. No.: 16/167,456

(22) Filed: Oct. 22, 2018

(65) Prior Publication Data

US 2019/0117001 A1 Apr. 25, 2019

Related U.S. Application Data

(60) Provisional application No. 62/575,839, filed on Oct. 23, 2017.

(51) Int. Cl.
*A47H 23/02* (2006.01)
*A47G 23/02* (2006.01)
*A47B 81/04* (2006.01)

(52) U.S. Cl.
CPC ..... *A47G 23/0208* (2013.01); *A47B 81/04* (2013.01)

(58) Field of Classification Search
CPC ..... A47G 23/0208; A47G 23/0641; A47B 81/04; A47B 7873/00; A47F 5/0846; A47F 5/0838
See application file for complete search history.

(56) References Cited

U.S. PATENT DOCUMENTS 278,161 A * 5/1883 McKee ..... A47B 73/00 211/74
1,925,540 A * 9/1933 Neuschotz ..... A47G 23/0208 211/74
2,449,197 A * 9/1948 Benziger ..... B65D 35/565 211/72
2,772,787 A * 12/1956 Lee ..... A47G 29/18 211/75
3,022,899 A * 2/1962 Unsworth ..... A47B 81/04 211/41.2
3,171,544 A * 3/1965 Unsworth ..... A47B 81/04 206/562
3,214,031 A * 10/1965 McCauley ..... A47B 81/007 211/181.1
4,019,638 A * 4/1977 Miller ..... A47F 5/0025 211/113
4,228,905 A * 10/1980 Cammarota ..... A47B 81/04 108/28
D269,926 S * 8/1983 White ..... D6/514
4,401,221 A * 8/1983 Suttles ..... A47F 7/285 211/59.2
D273,446 S * 4/1984 Rankin ..... D6/514
D275,433 S * 9/1984 Boland, II ..... D6/514
(Continued)

*Primary Examiner* — Patrick D Hawn
(74) *Attorney, Agent, or Firm* — Argus Intellectual Enterprise; Jordan Sworen; Daniel Enea

(57) ABSTRACT

An improved wine glasses rack includes a plurality of elongated bars. Wherein the plurality of elongated bars are interconnected to form an elongated cage adapted to slidably retain wine glasses therein and therefrom. Wherein the elongated cage is formed having an interior shape adapted to slidably retain a plurality of stemless wine glasses therein. Wherein the elongated cage is further formed and adapted to slidably retain a plurality of stemmed wine glasses therefrom. Wherein the improved wine glasses rack is adapted to be slidably and removably connected to and be hung from a wine glasses rack connected to a supporting surface.

12 Claims, 6 Drawing Sheets

(56) References Cited

U.S. PATENT DOCUMENTS

| | | | | | |
|---|---|---|---|---|---|
| 4,700,849 | A * | 10/1987 | Wagner | A47B 73/00 | 211/113 |
| D304,401 | S * | 11/1989 | Wagner | D7/705 | |
| D393,388 | S * | 4/1998 | Chen | D6/513 | |
| 5,785,189 | A * | 7/1998 | Gollob | A47F 7/285 | 108/109 |
| 5,971,167 | A * | 10/1999 | Finbow | A47G 23/0208 | 206/426 |
| 6,126,256 | A * | 10/2000 | Doces, II | A47B 81/04 | 211/71.01 |
| 6,283,566 | B1 * | 9/2001 | Doces, II | A47B 81/04 | 211/71.01 |
| 6,357,607 | B1 * | 3/2002 | Wu | A47B 81/04 | 211/75 |
| 6,631,812 | B2 * | 10/2003 | Ruiz | A47G 23/0208 | 211/113 |
| 6,843,381 | B2 * | 1/2005 | Wu | A47B 81/04 | 211/85.29 |
| 7,131,545 | B1 * | 11/2006 | Grogan | A47G 23/0208 | 211/85.29 |
| 7,207,448 | B1 * | 4/2007 | Marino, Jr. | B25H 3/023 | 100/54 |
| D553,454 | S * | 10/2007 | Goodman | D6/513 | |
| 8,016,132 | B2 * | 9/2011 | LaRiviere | A47G 23/0208 | 211/85.29 |
| 10,064,510 | B1 * | 9/2018 | Yablon | A47G 23/0208 | |
| 2003/0192845 | A1 * | 10/2003 | Lawson | A47F 5/0846 | 211/94.01 |
| 2006/0175274 | A1 * | 8/2006 | Yang | A47B 57/00 | 211/94.01 |
| 2007/0114195 | A1 * | 5/2007 | Patsalaridis | A47G 23/0208 | 211/85.29 |

* cited by examiner

STEMLESS WINE GLASSES RACK

CROSS-REFERENCE TO RELATED APPLICATION

The present application is related to and claims priority from prior provisional application Ser. No. 62/575,839, filed Oct. 23, 2017 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. Field of the Invention

The present invention relates generally to the field of rack devices and more specifically relates to an improved wine glasses rack adapted to be slidably and removably connected to and be hung from a wine glasses rack connected to a supporting surface.

2. Description of the Related Art

The storage of glassware is often conducted with a degree of tenderness due to the fragility of glass. A wine rack is a set of shelves for the organized storage of wine. Wine racks can be built out of a number of different materials. The size of the rack and the number of bottles it can hold can vary widely. Wine racks can be located in a winemaker's professional wine cellar as well as private homes for personal collection In general, and further it is desirable that wine glass be suspended upside down to allow the glasses to dry without streaking, spotting, or otherwise blemishing the glass or rim. Due to the nature of glass is not of a fixed nature and over time may deteriorate or 'run' as gravity acts on the rim of the glass. By hanging glassware upside down, the aforementioned detriments may be mitigated. But this action of suspending the glassware may conventionally only occur in conjunction with wine glasses with a pre-established stem to them.

Ideally, an improved wine glasses rack should be user-friendly and safe in-use and, yet would operate reliably and be manufactured at a modest expense. Thus, a need exists for an improved wine glasses rack adapted to be slidably and removably connected to and be hung from a wine glasses rack connected to a supporting surface and to avoid the above-mentioned problems.

BRIEF SUMMARY OF THE INVENTION

In view of the foregoing disadvantages inherent in the known of rack device art, the present invention provides a novel improved wine glasses rack (Stemless Wine Glass Rack). The general purpose of the present invention, which will be described subsequently in greater detail is to provide an improved wine glasses rack adapted to be slidably and removably connected to and be hung from a wine glasses rack connected to a supporting surface.

An improved wine glasses rack comprising: a plurality of elongated bars. Wherein the plurality of elongated bars are interconnected to form an elongated cage adapted to slidably retain wine glasses therein and therefrom. Wherein the elongated cage is formed having an interior shape adapted to slidably retain a plurality of stemless wine glasses therein. Wherein the elongated cage is further formed and adapted to slidably retain a plurality of stemmed wine glasses therefrom. Wherein the improved wine glasses rack is adapted to be slidably and removably connected to and be hung from a wine glasses rack connected to a supporting surface.

An improved wine glasses rack system comprising: a wine glasses rack and an improved wine rack. The wine glasses rack includes: at least one elongated slot including two opposing elongated edge portions. Wherein the two opposing elongated edge portions are adapted to slidably and removably retain a plurality of stemmed wine glasses there upon. Wherein the wine glasses rack is adapted to be connected to a supporting surface.

The improved wine rack comprises a plurality of elongated bars. Wherein the plurality of elongated bars are interconnected to form an elongated cage adapted to slidably retain wine glasses therein and therefrom. Wherein the elongated cage is formed having an interior shape adapted to slidably retain a plurality of stemless wine glasses therein. Wherein the elongated cage is further formed and adapted to slidably retain a plurality of stemmed wine glasses therefrom. Wherein two of the plurality of elongated bars are adapted to be slidably received and retained by the two opposing elongated edge portions of any one of the at least one elongated slot of the wine glasses rack, such that said improved wine glasses rack can be slidably and removably retained and hung from the wine glasses rack when the wine glasses rack is connected to a supporting surface.

The present invention holds significant improvements and serves as a improved wine glasses rack. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, an Improved Wine Glasses Rack (Stemless Wine Glass Rack), constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to a rack device and more particularly to an Improved Wine Glasses Rack (Stemless Wine Glass Rack) adapted to be slidably and removably connected to and be hung from a wine glasses rack connected to a supporting surface.

Figure 1:
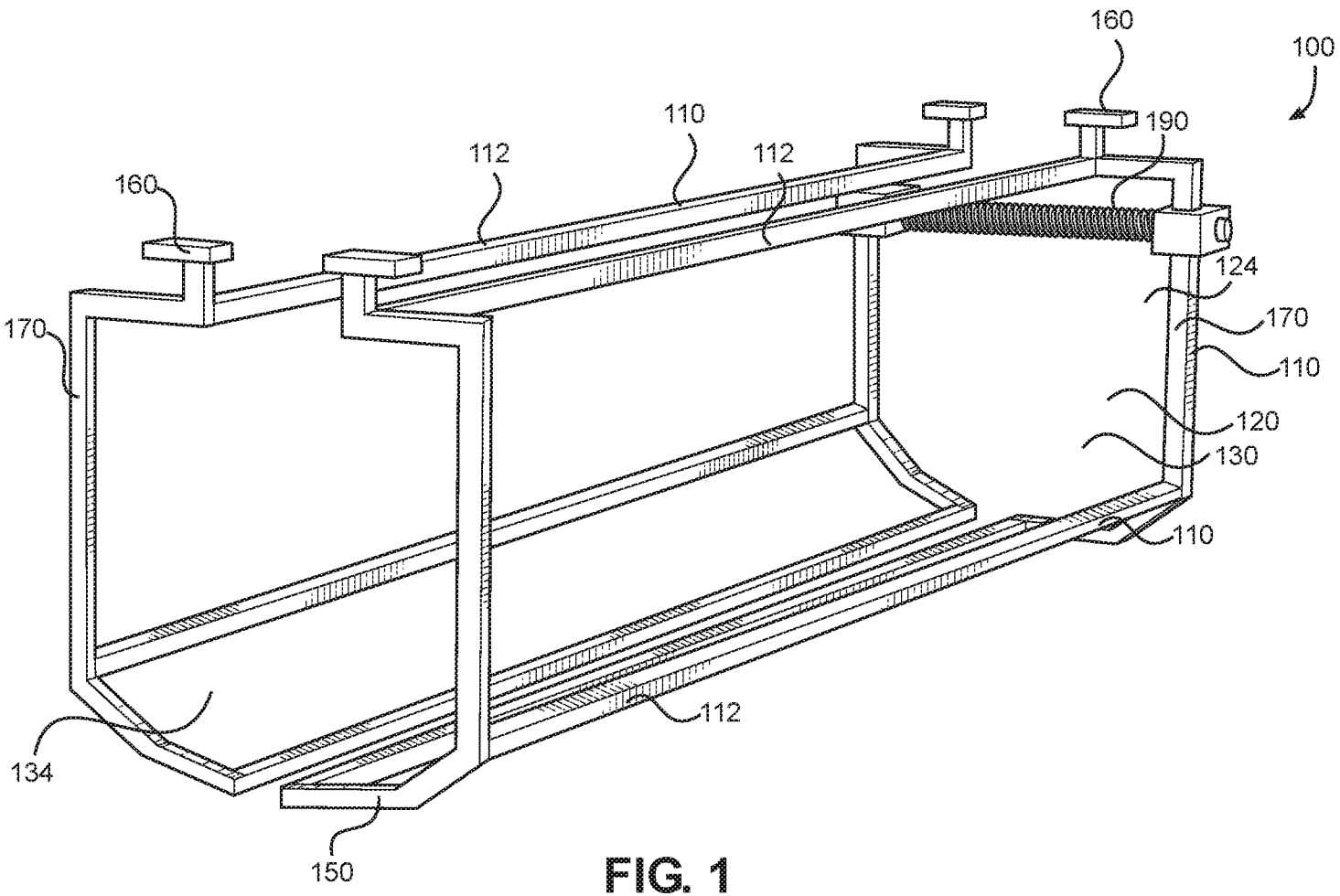
FIG. 1 shows a perspective view illustrating an Improved Wine Glasses Rack according to an embodiment of the present invention.
Figure 2:
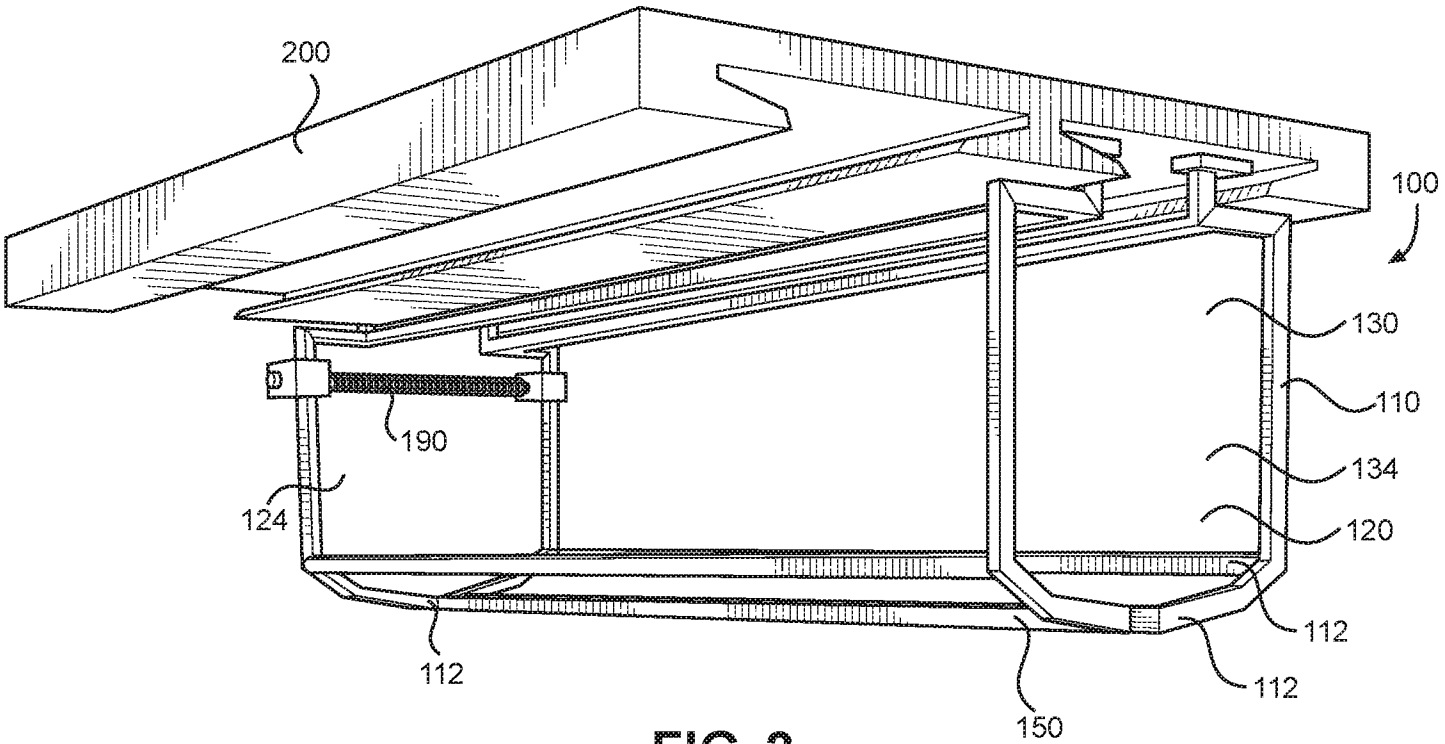
FIG. 2 is a perspective view illustrating an improved wine glasses rack connected to a supporting surface according to an embodiment of the present invention of FIG. 1.

Referring to the drawings by numerals of reference there is shown in FIGS. 1 & 2, showing perspective views illustrating improved wine glasses rack 100 according to an embodiment of the present invention.

Improved wine glasses rack 100 comprising: plurality of elongated bars 110. Wherein plurality of elongated bars 110 are interconnected to form elongated cage 120 adapted to slidably retain wine glasses 350 therein and therefrom. Wherein elongated cage 120 is formed having interior shape 130 adapted to slidably retain plurality of stemless wine glasses 360 therein. Wherein interior shape 130 of elongated cage 120 is formed having U-shaped cross-section 134 adapted to securely, slidably, and removably retain stemless wine glasses 360 therein having U-shaped cross-section 134. Wherein plurality of elongated bars 110 are formed from a material chosen from a list of materials consisting of stainless steel, aluminum, copper, plastic, and ceramic.

Wherein the elongated cage 120 is further formed and adapted to slidably retain plurality of stemmed wine glasses 350 therefrom. Wherein improved wine glasses rack 100 is adapted to be slidably and removably connected to and be hung from wine glasses rack 150 connected to supporting surface 200.

Wherein two 112 of plurality of elongated bars 110 are adapted to be slidably received and retained by two opposing elongated edge portions 170 of elongated slot 160 of wine glasses rack 150, to thereby adapt improved wine glasses rack 150 to be removably retained and hung from wine glasses rack 150 connected to supporting surface 200. Wherein two 112 of plurality of elongated bars 110 are spaced from one another and adapted to slidably receive and retain base portions of stemmed wine glasses 350 there upon, such that stemmed wine glasses 350 can hang from cage 120 at the same time stemless wine glasses 360 are stored within interior volume 124 of cage 120.

Improved wine glasses rack 100, further comprising blocking bar 190 at one end of elongated cage 120, is connected between two 112 of plurality of elongated bars 110, and is adapted to prevent stemless wine glasses 360 from falling out from interior volume 124 of cage 120 at said one end.

Figure 3:
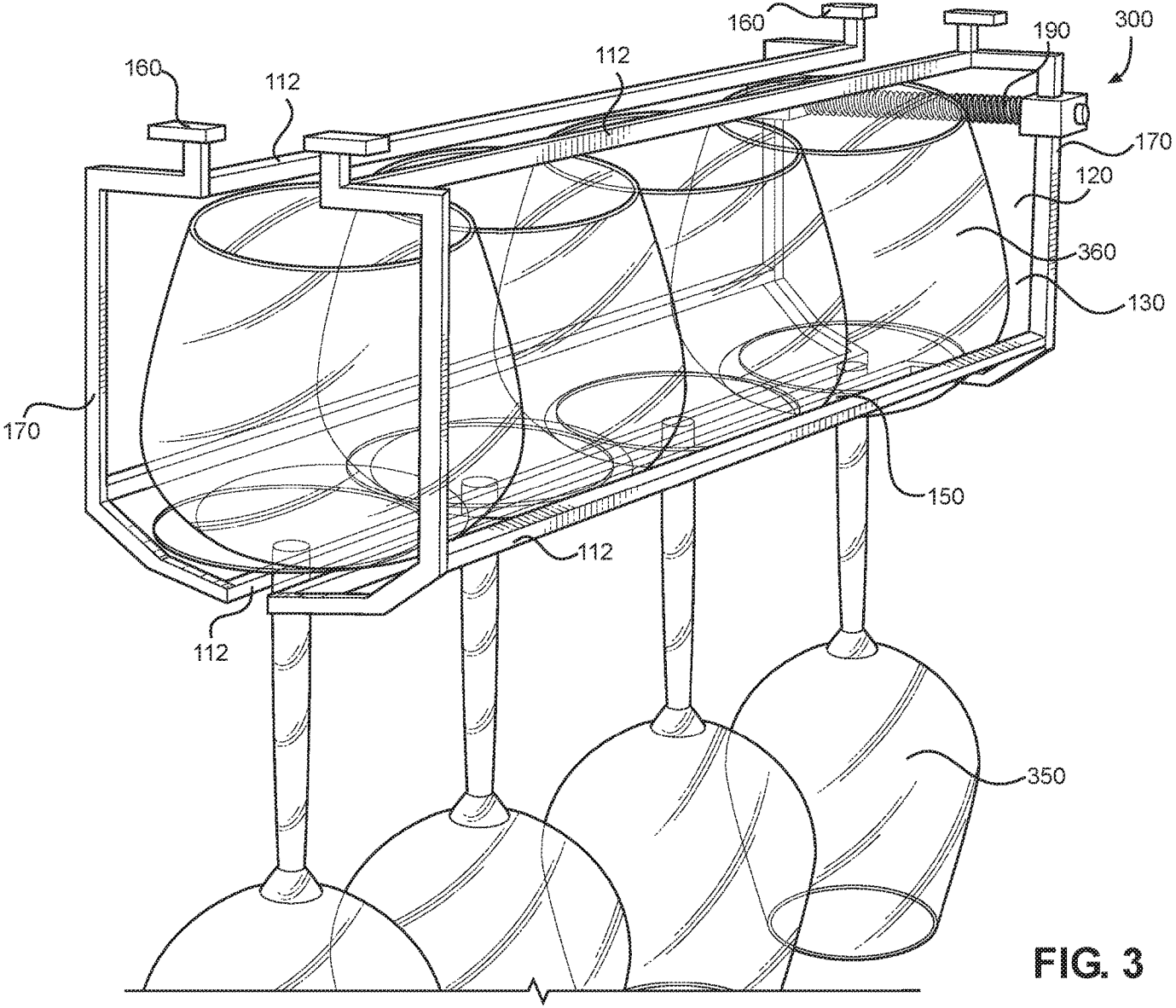
FIG. 3 is a perspective view illustrating an Improved Wine Glasses Rack System according to an embodiment of the present invention of FIG. 1.
Figure 4:
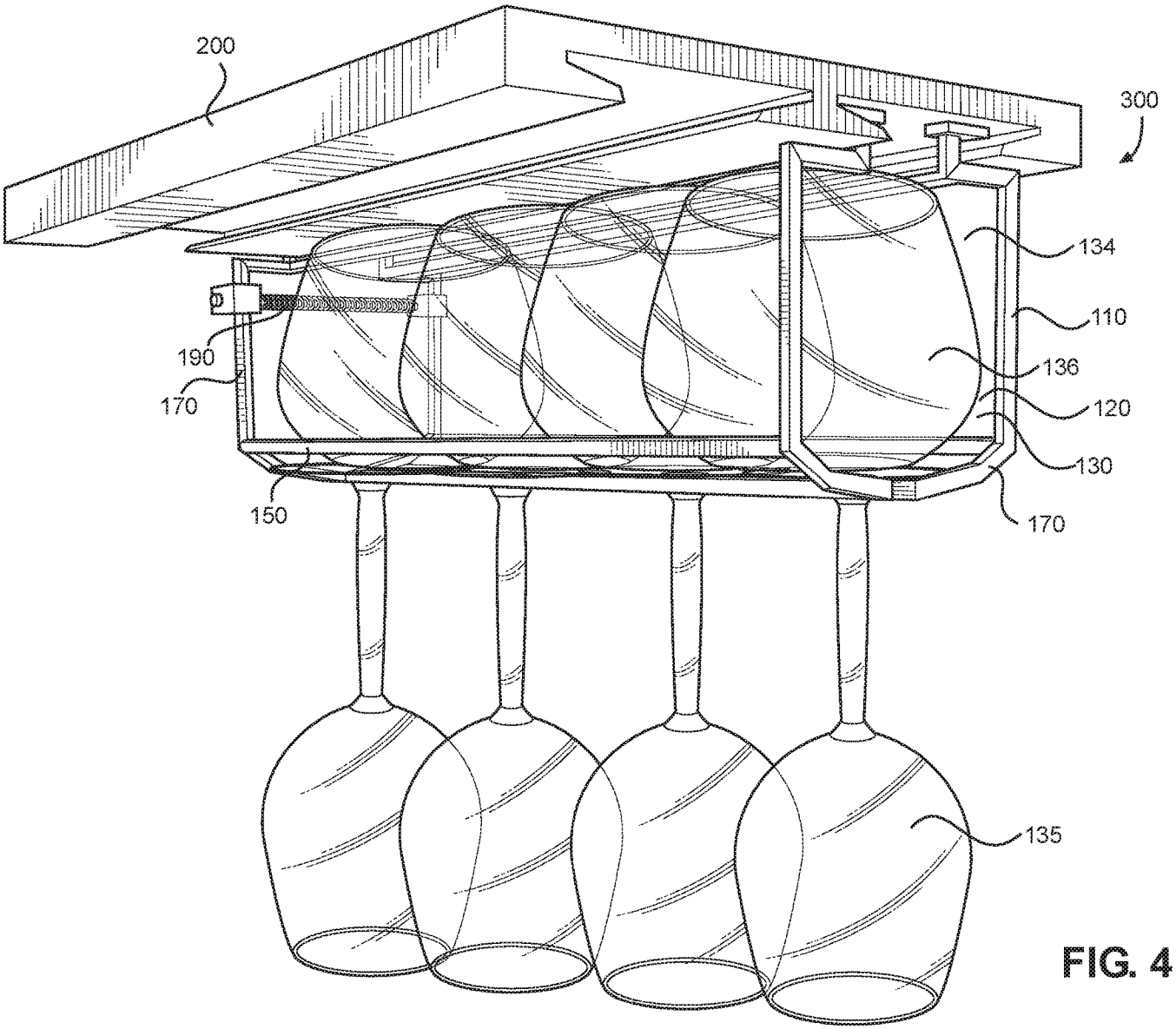
FIG. 4 is a perspective view illustrating Improved Wine Glasses Rack System attached to a supporting surface according to an embodiment of the present invention of FIG. 1.
Figure 5:
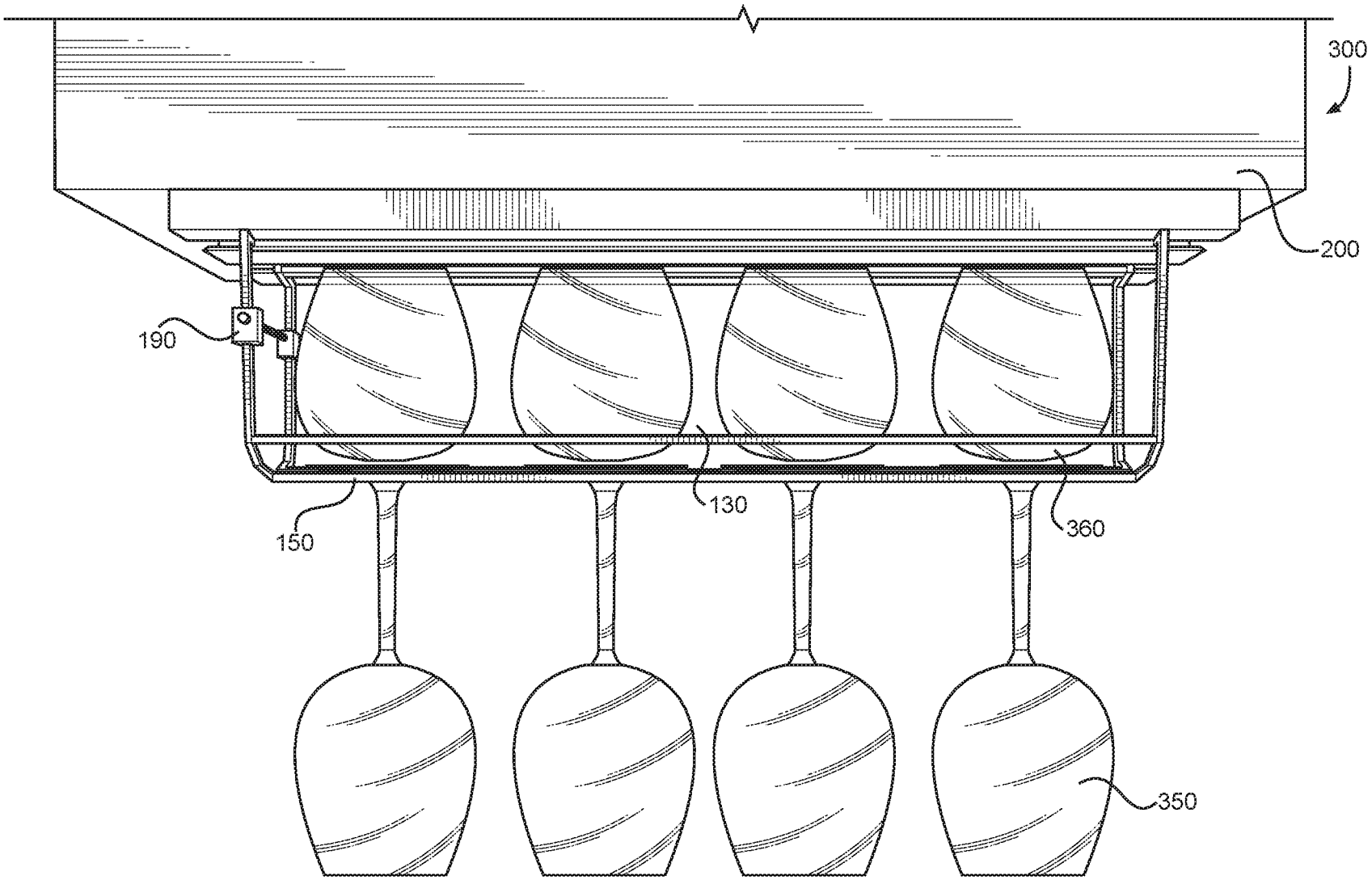
FIG. 5 is a perspective view illustrating another view of the Improved Wine Glasses Rack System attached to a supporting surface according to an embodiment of the present invention of FIG. 1.
Figure 6:
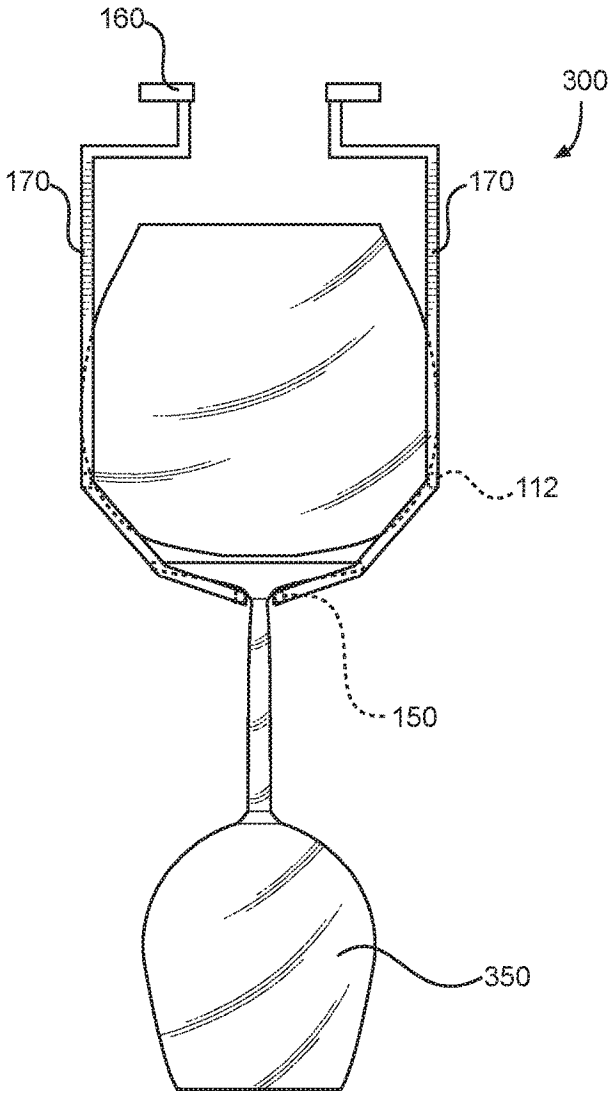
FIG. 6 is a side perspective view illustrating another view of the Improved Wine Glasses Rack System attached to a supporting surface according to an embodiment of the present invention of FIG. 1.

Referring now to FIGS. 2-3 illustrating perspective views showing improved wine glasses rack system 300 according to an embodiment of the present invention.

Improved wine glasses rack system 300 comprising: wine glasses rack 150 and improved wine rack 100. Wine glasses rack 150 includes: at least one elongated slot 160 including two opposing elongated edge portions 170. Wherein two opposing elongated edge portions 170 are adapted to slidably and removably retain plurality of stemmed wine glasses 350 there upon. Wherein wine glasses rack 150 is adapted to be connected to supporting surface 200.

Wherein two 112 of the plurality of elongated bars 110 are adapted to be slidably received and retained by two opposing elongated edge portions 170 of any one of at least one elongated slot 160 of the wine glasses rack 150, such that improved wine rack 100 can be slidably and removably retained and hung from wine glasses rack 150 when wine glasses rack 150 is connected to supporting surface 200.

Wherein wine glasses rack 150 is formed having two spaced elongated slots 160. Improved wine glasses rack system 300 further comprising two improved wine racks 100 adapted to be slidably and removably retained and hung from respective two spaced elongated slots 160 of said wine glasses rack 150.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is:

1. A wine glasses rack, comprising:

a first glass rack assembly, comprising:

a top elongated member connected to a subframe via a connecting member, wherein the subframe comprises a side elongated member and a bottom elongated member, wherein the top elongated member and the subframe each extend between a first end and a second end;

a mounting tab adapted to slidably engage a recess in a support surface;

wherein the mounting tab is disposed on a longitudinal plane above the top elongated member;

a second glass rack assembly, comprising:

a top elongated member connected to a subframe via a connecting member, wherein the subframe member comprises a side elongated member and a bottom elongated member, wherein the top elongated member and the subframe each extend between a first end and a second end;

a mounting tab adapted to slidably engage a recess in a support surface;

wherein the mounting tab is disposed on a longitudinal plane above the top elongated member;

wherein the first glass rack assembly and the second glass rack assembly cooperatively form an elongated cage having an interior volume that is adapted to house stemless glassware therein;

wherein the subframes of the first and second glass rack assemblies form a suspension channel therebetween, wherein the suspension channel is adapted to receive the stem glassware and wherein the bottom elongated members of the first and second glass rack assemblies are adapted to support a base of the stem glassware hanging therefrom;

wherein the subframe of the first and second glass rack assemblies form a support channel, wherein the support channel is sized to receive the stemless glassware therein and the subframe of the first and second glass rack assemblies support the stemless glassware thereon;

wherein first glass rack assembly and the second glass rack assembly are each adapted to be slidably and removably connected to and be suspended from the support surface; and a blocking bar connected to the connecting member of the first glass rack assembly and the second glass rack assembly, respectively, wherein the blocking bar is adapted to prevent stemless glassware from falling out from said interior volume, the blocking bar is slidably adjustable along the vertical frame member of the first glass rack assembly and the second glass rack assembly, respectively.

2. The wine glasses rack of claim 1, wherein the suspension channel extends entirely between the first end and the second end.

3. The wine glasses rack of claim 2, wherein the suspension channel has a uniform width thereacross.

4. The wine glasses rack of claim 1, wherein the mounting tabs of the first and second glass rack assemblies are adapted to engage a support surface comprising a dovetail groove.

5. The wine glasses rack of claim 1, wherein support surface comprises a dovetail groove adapted to receive the mounting tabs of the first and second glass rack assemblies.

6. The wine glasses rack of claim 1, wherein the side elongated member of the first and second glass rack assemblies are adapted to support the stemless glassware overhead stem glassware when suspended by the bottom elongated member of the first and second glass rack assemblies.

7. The wine glasses rack of claim 1, wherein the suspension channel and the support channel are disposed on a same axis between the first end and the second end, wherein the suspension channel and the support channel are vertically offset.

8. The wine glasses rack of claim 1, wherein the suspension channel and the support channel are adapted to retain a single row of stem glassware and stemless glassware, respectively.

9. The wine glasses rack of claim 1, wherein the wine glasses rack is formed from a material chosen from a list of materials consisting of stainless steel, aluminum, copper, plastic, and ceramic.

10. The wine glasses rack of claim 1, wherein the first glass rack assembly and the second glass rack assembly are entirely identical.

11. The wine glasses rack of claim 1, wherein the blocking bar is disposed intermediate the support channel and the mounting tabs of the first glass rack assembly and the second glass rack assembly, respectively.

12. The wine glasses rack of claim 3, wherein only a single suspension channel is formed between the subframes of the first and second glass rack assemblies.

* * * * *